US006742190B1

(12) United States Patent
Tobelmann

(10) Patent No.: US 6,742,190 B1
(45) Date of Patent: Jun. 1, 2004

(54) BRIDGING GLOVE

(76) Inventor: Andrew Tobelmann, 300 Barneston Rd., Glenmore, PA (US) 19343

( * ) Notice: Subject to any disclaimer, the term of this patent is extended or adjusted under 35 U.S.C. 154(b) by 0 days.

(21) Appl. No.: 10/358,714

(22) Filed: Feb. 5, 2003

(51) Int. Cl.[7] ..... A41D 19/00
(52) U.S. Cl. ..... 2/159; 2/161.1
(58) Field of Search ..... 2/16, 20, 21, 159, 2/160, 161.1, 161.6, 163; 473/1

(56) References Cited

U.S. PATENT DOCUMENTS 3,544,111 A 12/1970 Crisman et al.
4,025,962 A 5/1977 Hartung
4,064,563 A 12/1977 Stokes
4,694,508 A * 9/1987 Iriyama et al. ..... 2/21
4,877,242 A 10/1989 James
5,577,272 A * 11/1996 Fisher ..... 2/21
5,661,853 A * 9/1997 Wilmot ..... 2/163
5,752,279 A * 5/1998 Hochmuth ..... 2/161.1
5,881,385 A * 3/1999 Hochmuth ..... 2/161.1
5,881,388 A * 3/1999 Pratt ..... 2/163
6,393,616 B1 * 5/2002 Woodard ..... 2/163

* cited by examiner

*Primary Examiner*—Gary L. Welch

(57) ABSTRACT

A bridging glove for increasing the height of a hand of a user positioned to bridge a pool cue. The bridging glove includes a glove member comprising a perimeter wall defining an interior space of the glove member designed for receiving the hand of the user. The glove member comprises a plurality of finger portions designed for receiving fingers of the hand of the user. One of a plurality of insert members is selectively inserted into each of the finger portions of the glove member. Each of the insert members is positioned in a free end of the associated one of the finger portions of the glove member for being positioned between the fingers and a billiard table for raising the hand above the billiard table when the hand is used to form a bridge for the cue.

9 Claims, 3 Drawing Sheets

BRIDGING GLOVE

BACKGROUND OF THE INVENTION

1. Field of the Invention

The present invention relates to pool gloves and more particularly pertains to a new bridging glove for increasing the height of a hand of a user positioned to bridge a pool cue.

2. Description of the Prior Art

The use of pool gloves is known in the prior art. U.S. Pat. No. 4,877,242 describes a device for fitting over a hand of the user that has cue inserting elements to allow the user to strike the cue ball. Another type of pool glove is U.S. Pat. No. 4,025,962 having a glove that is worn on the hand of the user to sheath the fingers of the user when the user cradles a pool cue. U.S. Pat. No. 4,064,563 has a glove that receives the palm, thumb and fingers of the hand to frictionally engaging the pool cue to prevent the pool cue from inadvertently slipping. U.S. Pat. No. 3,544,111 has a hollow rigid form for receiving the hand of the user to allow the user to practice proper positioning of the hand when the user is bridging for a pool cue.

While these devices fulfill their respective, particular objectives and requirements, the need remains for a device that has certain improved features allowing for the hand of the user to be positioned at a greater height above the billiard table.

SUMMARY OF THE INVENTION

The present invention meets the needs presented above by providing a plurality of insert members that are inserted into the finger portions of the glove member to position the hand of the user higher above the billiard table.

Still yet another object of the present invention is to provide a new bridging glove that provides stability to the hand of the user while raising the hand of the user above the billiard table when the hand is used to form a bridge for a pool cue.

Even still another object of the present invention is to provide a new bridging glove that allows the fingernails of the user to extend between the insert members and the glove member to protect the fingernails from damage when the hand of the user is used to form a bridge for a pool cue.

To this end, the present invention generally comprises a glove member comprising a perimeter wall defining an interior space of the glove member. The interior space is designed for receiving the hand of the user. The glove member comprises a plurality of finger portions. The finger portions are designed for receiving fingers of the hand of the user. One of a plurality of insert members is selectively inserted into each of the finger portions of the glove member when the hand of the user is removed from the interior space of the glove member. Each of the insert members is positioned in a free end of the associated one of the finger portions of the glove member whereby the insert members are designed for being positioned between the fingers and a billiard table for raising the hand above the billiard table when the hand is used to bridge the cue while the user is using the cue to strike a ball.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
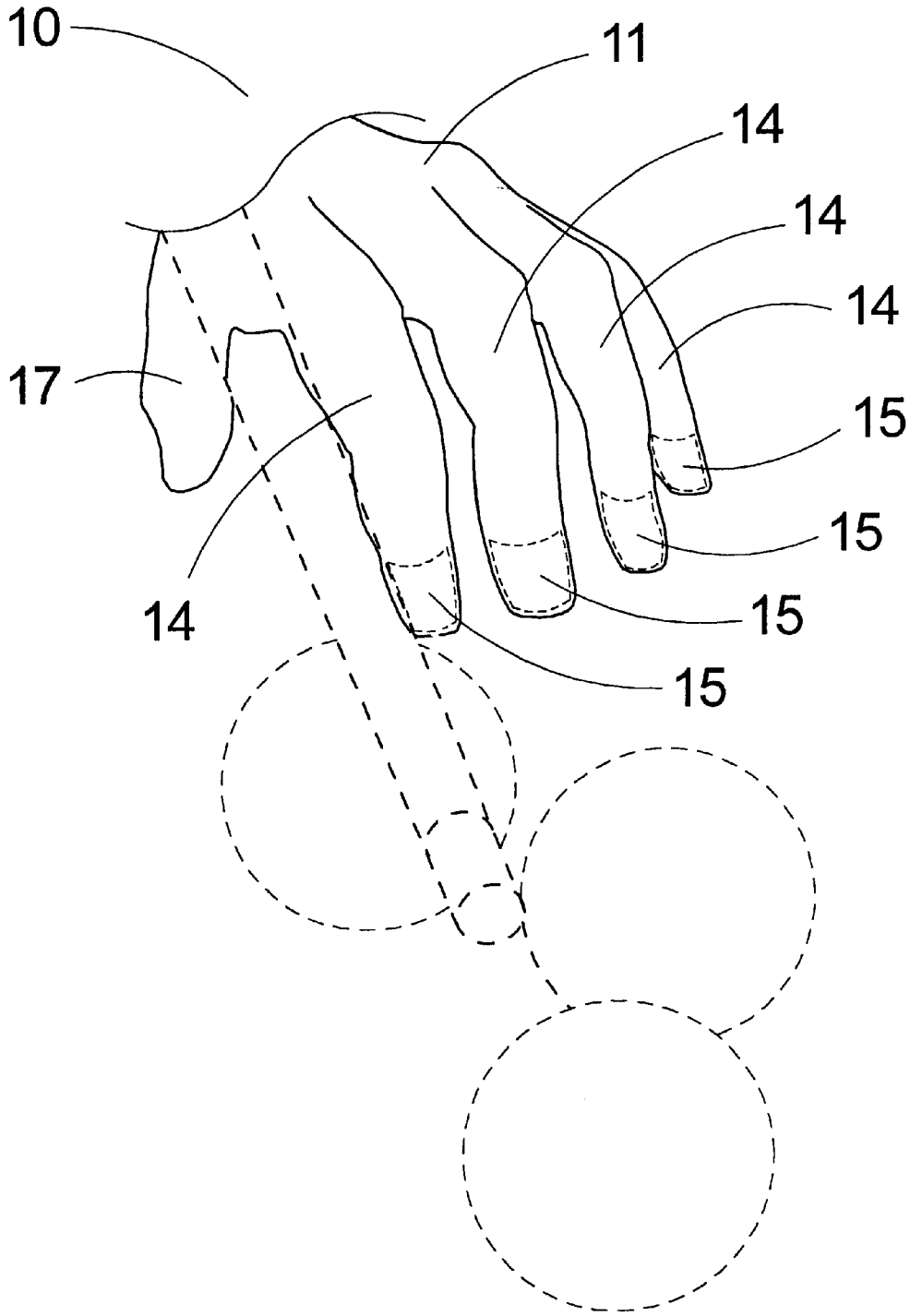
FIG. 1 is a perspective view of a new bridging glove according to the present invention in use.
Figure 2:
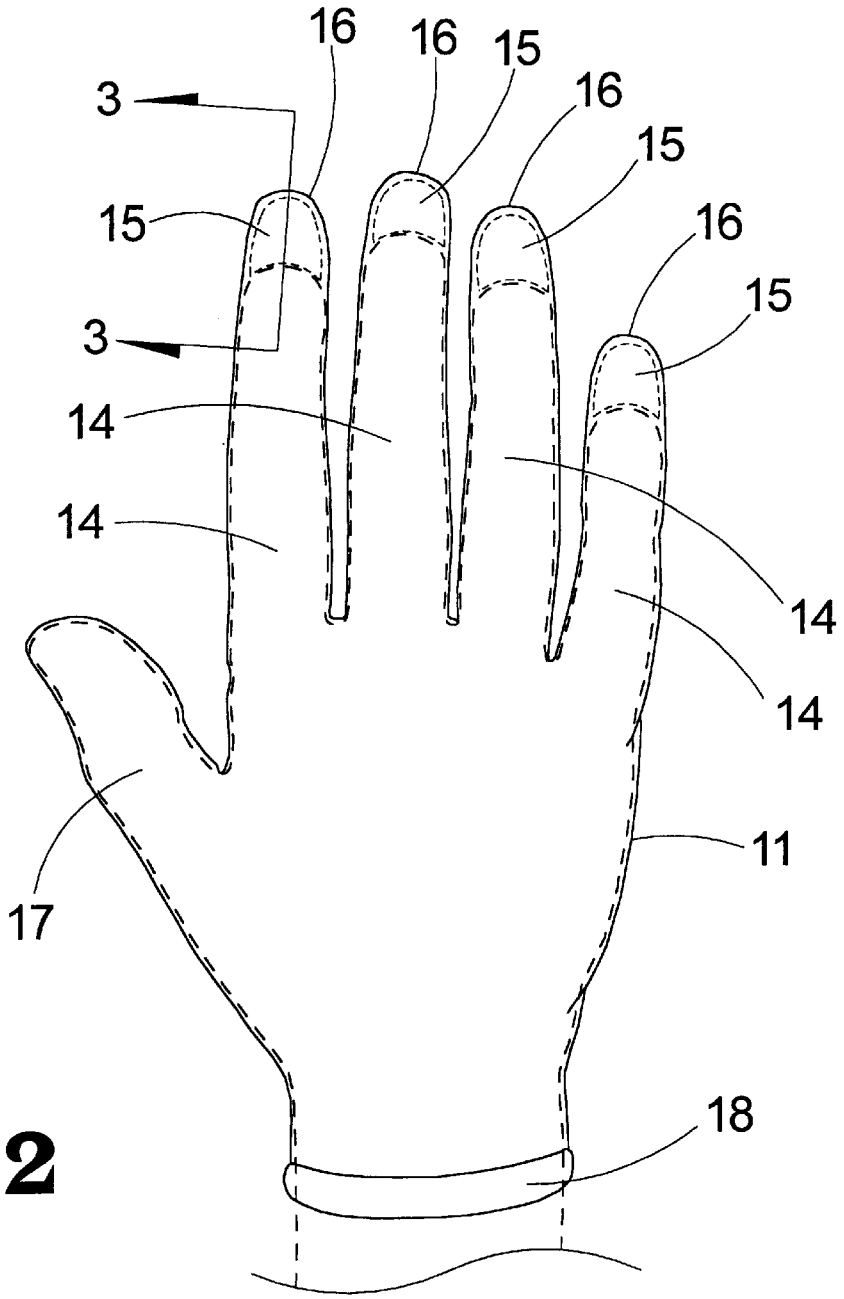
FIG. 2 is a bottom view of the present invention shown in use.
Figure 3:
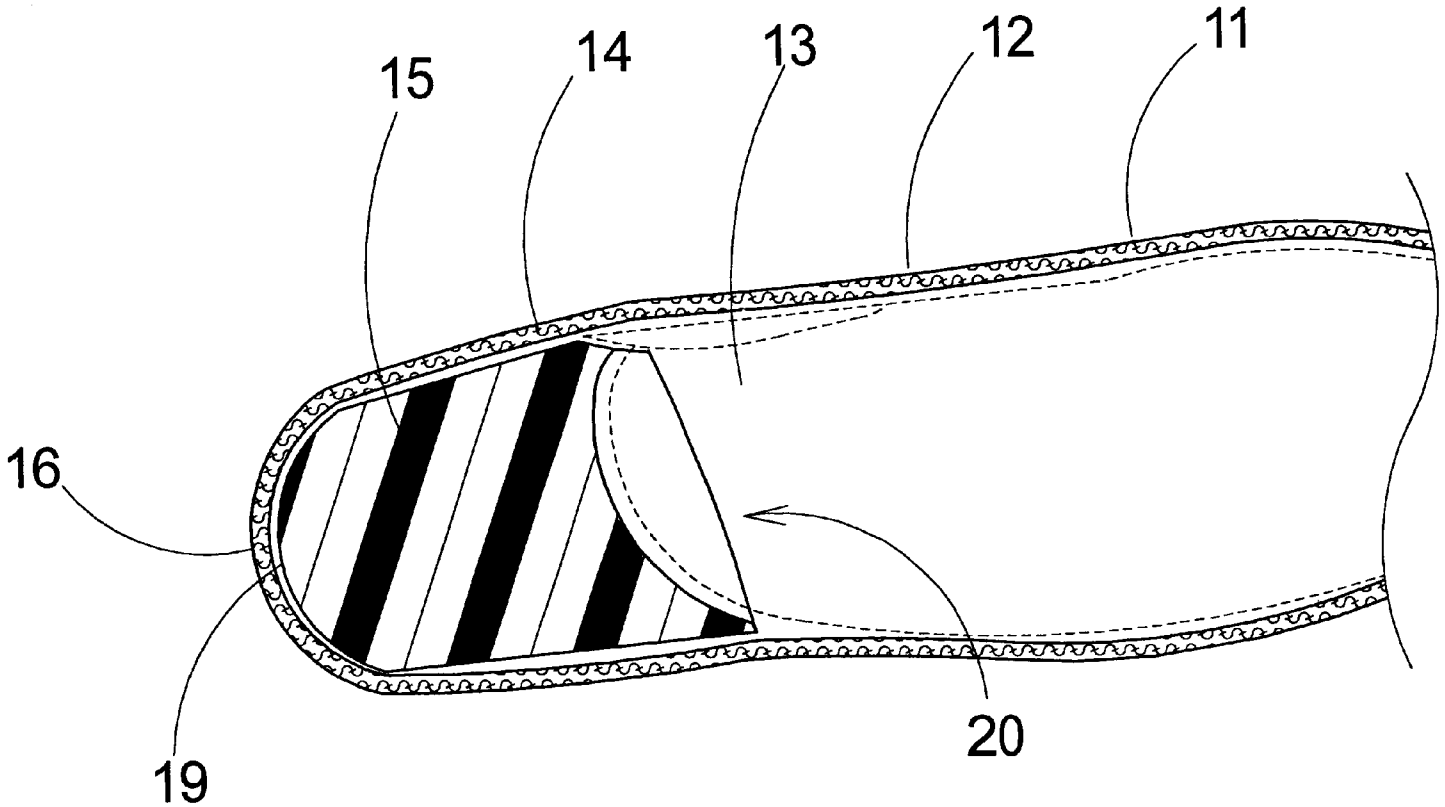
FIG. 3 is a cross-sectional view of the present invention taken along line 3—3 of FIG. 2.

With reference now to the drawings, and in particular to FIGS. 1 through 3 thereof, a new bridging glove embodying the principles and concepts of the present invention and generally designated by the reference numeral 10 will be described.

As best illustrated in FIGS. 1 through 3, the bridging glove 10 generally comprises a glove member 11 comprising a perimeter wall 12 defining an interior space 13 of the glove member 11. The interior space 13 is designed for receiving the hand of the user. The glove member 11 comprises a plurality of finger portions 14. The finger portions 14 are designed for receiving fingers of the hand of the user.

One of a plurality of insert members 15 is selectively inserted into each of the finger portions 14 of the glove member 11 when the hand of the user is removed from the interior space 13 of the glove member 11. Each of the insert members 15 is positioned in a free end 16 of the associated one of the finger portions 14 of the glove member 11 whereby the insert members 15 are designed for being positioned between the fingers and a billiard table for raising the hand above the billiard table when the hand is used to bridge the cue while the user is using the cue to strike a ball. Each of the insert members 15 comprises a length between ½ inch and 2 inches to provide adequate positioning of the hand of the user above the billiard table.

The glove member 11 comprises a thumb portion 17. The thumb portion 17 is designed for receiving a thumb of the hand of the user when the hand of the user is positioned in the interior space 13 of the glove member 11.

The glove member 11 comprises a cuff portion 18. The cuff portion 18 is positioned opposite the finger portions 14 whereby the cuff portion 18 is designed for being positioned around a wrist of the user to inhibit inadvertent removal of the glove member 11 from the hand of the user.

The glove member 11 comprises an elastic friction reducing material, such as a stretch satin fabric. The elastic friction reducing material is designed for stretching around the hand of the user to provide a snug fit when the hand of the user is positioned in the interior space 13 of the glove member 11. The elastic friction reducing material is designed for permitting the cue to slide easily across the glove member 11 when the hand of the user is positioned on the billiard table to form the bridge for the cue.

Each of the insert members 15 comprises a distal end 19. The distal end 19 of each of the insert members 15 is designed for being positioned opposite the associated one of the fingers of the hand of the user when the insert members 15 are positioned in the associated one of the finger portions 14 of the glove member 11. The distal end 19 of each of the insert members 15 is convex whereby the distal end 19 of each of the insert members 15 conforms to the free end 16 of the associated one of the finger portions 14 of the glove member 11.

Each of the insert members 15 comprises a proximal end 20. The proximal end 20 is designed for abutting against the associated one of the fingers of the user when the hand of the user is positioned in the glove member 11. The proximal end 20 of each of the insert members 15 is convex whereby the proximal end 20 is designed for cradling the fingertip of the associated one of the fingers of the user to inhibit the insert members 15 from sliding with respect to the associated one of the fingers when the hand of the user is positioned in the glove member 11.

In use, the user inserts the insert members 15 into the finger portions 14 to the glove member 11 making sure that the distal end 19 of the insert members 15 are positioned in the free end 16 of the associated one of the finger portions 14. The user then inserts a hand into the interior space 13 of the glove member 11 so that the fingertips abut the associated one of the insert members 15. The user then places a hand on the billiard table to form a bridge for the cue. The insert members 15 extend between the fingers and the billiard table thereby raising the hand away from the billiard table and provide a better angle for using the cue to strike the cue ball, for instance when the cue ball is positioned proximate another one of the billiard balls.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A bridging glove for repositioning a hand of a user when the user is using the hand to bridge a cue during a game of billiards, the bridging glove comprising:

a glove member comprising a perimeter wall defining an interior space of said glove member, said interior space being adapted for receiving the hand of the user, said glove member comprising a plurality of finger portions, said finger portions being adapted for receiving fingers of the hand of the user;

one of a plurality of insert members being selectively inserted into each of said finger portions of said glove member when the hand of the user is removed from said interior space of said glove member, each of said insert members being positioned in a free end of the associated one of said finger portions of said glove member such that said insert members are adapted for being positioned between the fingers and a billiard table for raising the hand above the billiard table when the hand is used to bridge the cue while the user is using the cue to strike a ball;

each of said insert members comprising a proximal end, said proximal end being adapted for abutting against the associated one of the fingers of the user when the hand of the user is positioned in said glove member, said proximal end of each of said insert members being convex such that said proximal end is adapted for cradling the fingertip of the associated one of the fingers of the user to inhibit said insert members from sliding with respect to the associated one of the fingers when the hand of the user is positioned in said glove member; and each of said insert members comprising an arcuate cutout, said arcuate cutout extending from an upper face of the associated one of said insert members to said proximal end of the associated one of said insert members, said arcuate cutout being adapted for permitting a fingernail of the finger of the user to be positioned between the associated one of said insert members and said glove member such that said arcuate cutout inhibits the fingernail from being bent and damaged when the hand of the user is positioned in said glove member.

2. The bridging glove as set forth in claim 1, further comprising:

said glove member comprising a thumb portion, said thumb portion being adapted for receiving a thumb of the hand of the user when the hand of the user is positioned in said interior space of said glove member.

3. The bridging glove as set forth in claim 1, further comprising:

said glove member comprising a cuff portion, said cuff portion being positioned opposite said finger portions such that said cuff portion is adapted for being positioned around a wrist of the user to inhibit inadvertent removal of said glove member from the hand of the user.

4. The bridging glove as set forth in claim 1, further comprising:

said glove member comprising an elastic friction reducing material, said elastic friction reducing material being adapted for stretching around the hand of the user to provide a snug fit when the hand of the user is positioned in said interior space of said glove member, said elastic friction reducing material being adapted for permitting the cue to slide easily across said glove member when the hand of the user is positioned on the billiard table to form the bridge for the cue.

5. The bridging glove as set forth in claim 1, further comprising:

each of said insert members comprising a distal end, said distal end of each of said insert members being adapted for being positioned opposite the associated one of the fingers of the hand of the user when said insert members are positioned in the associated one of said finger portions of said glove member, said distal end of each of said insert members being convex such that said distal end of each of said insert members conforms to said free end of the associated one of said finger portions of said glove member.

6. The bridging glove as set forth in claim 1, further comprising:

each of said insert members comprising a length, said length of each of said insert members being between ½ inch and 2 inches to provide adequate positioning of the hand of the user above the billiard table.

7. A bridging glove for repositioning a hand of a user when the user is using the hand to bridge a cue during a game of billiards, the bridging glove comprising:

a glove member comprising a perimeter wall defining an interior space of said glove member, said interior space being adapted for receiving the hand of the user, said glove member comprising a plurality of finger portions, said finger portions being adapted for receiving fingers of the hand of the user;

one of a plurality of insert members being selectively inserted into each of said finger portions of said glove member when the hand of the user is removed from said interior space of said glove member, each of said insert members being positioned in a free end of the associated one of said finger portions of said glove member such that said insert members are adapted for being positioned between the fingers and a billiard table for raising the hand above the billiard table when the hand is used to bridge the cue while the user is using the cue to strike a ball;

said glove member comprising a thumb portion, said thumb portion being adapted for receiving a thumb of the hand of the user when the hand of the user is positioned in said interior space of said glove member;

said glove member comprising a cuff portion, said cuff portion being positioned opposite said finger portions such that said cuff portion is adapted for being positioned around a wrist of the user to inhibit inadvertent removal of said glove member from the hand of the user;

each of said insert members comprising a distal end, said distal end of each of said insert members being adapted for being positioned opposite the associated one of the fingers of the hand of the user when said insert members are positioned in the associated one of said finger portions of said glove member, said distal end of each of said insert members being convex such that said distal end of each of said insert members conforms to said free end of the associated one of said finger portions of said glove member;

each of said insert members comprising a proximal end, said proximal end being adapted for abutting against the associated one of the fingers of the user when the hand of the user is positioned in said glove member, said proximal end of each of said insert members being convex such that said proximal end is adapted for cradling the fingertip of the associated one of the fingers of the user to inhibit said insert members from sliding with respect to the associated one of the fingers when the hand of the user is positioned in said glove member; and each of said insert members comprising an arcuate cutout, said arcuate cutout extending from an upper face of the associated one of said insert members to said proximal end of the associated one of said insert members, said arcuate cutout being adapted for permitting a fingernail of the finger of the user to be positioned between the associated one of said insert members and said glove member such that said arcuate cutout inhibits the fingernail from being bent and damaged when the hand of the user is positioned in said glove member.

8. The bridging glove as set forth in claim 7, further comprising:

each of said insert members comprising a length, said length of each of said insert members being between ½ inch and 2 inches to provide adequate positioning of the hand of the user above the billiard table.

9. The bridging glove as set forth in claim 7, further comprising:

said glove member comprising an elastic friction reducing material, said elastic friction reducing material being adapted for stretching around the hand of the user to provide a snug fit when the hand of the user is positioned in said interior space of said glove member, said elastic friction reducing material being adapted for permitting the cue to slide easily across said glove member when the hand of the user is positioned on the billiard table to form the bridge for the cue.

* * * * *